US011297879B2

(12) United States Patent
Scatterday

(10) Patent No.: US 11,297,879 B2
(45) Date of Patent: Apr. 12, 2022

(54) METHODS AND APPARATUS FOR A POD VAPING SYSTEM

(71) Applicant: Mark Scatterday, Scottsdale, AZ (US)

(72) Inventor: Mark Scatterday, Scottsdale, AZ (US)

(73) Assignee: Jupiter Research. LLC, Phoenix, AZ (US)

( * ) Notice: Subject to any disclaimer, the term of this patent is extended or adjusted under 35 U.S.C. 154(b) by 157 days.

(21) Appl. No.: 16/573,787

(22) Filed: Sep. 17, 2019

(65) Prior Publication Data

US 2020/0085104 A1 Mar. 19, 2020

Related U.S. Application Data

(60) Provisional application No. 62/732,207, filed on Sep. 17, 2018.

(51) Int. Cl.
*A24F 40/40* (2020.01)

(52) U.S. Cl.
CPC ..... *A24F 40/40* (2020.01)

(58) Field of Classification Search
CPC ..... A24F 40/40; A24F 40/00; A24F 47/002; A24F 47/008; A24F 40/42
USPC ..... 131/328, 329
See application file for complete search history.

(56) References Cited

U.S. PATENT DOCUMENTS 8,499,766 B1 * 8/2013 Newton ..... A24F 40/40 131/273
2017/0035117 A1 * 2/2017 Lin ..... H01M 50/213
2017/0188633 A1 * 7/2017 Force ..... H05B 1/0244
2018/0027880 A1 * 2/2018 Dong ..... A61M 15/06
2019/0037926 A1 * 2/2019 Qiu ..... A24F 40/40
2019/0124996 A1 * 5/2019 Qiu ..... A24F 40/40
2019/0350262 A1 * 11/2019 Saygili ..... A24F 40/30
2020/0077704 A1 * 3/2020 Ouyang ..... A24F 40/40
2020/0288770 A1 * 9/2020 Potter ..... A24F 40/40
2020/0297033 A1 * 9/2020 Wang ..... A24F 40/485
2020/0305511 A1 * 10/2020 Wilson ..... A24F 40/40
2020/0315257 A1 * 10/2020 Rostami ..... A24B 15/167
2020/0337375 A1 * 10/2020 Guo ..... A24F 40/40
2020/0367556 A1 * 11/2020 Lin ..... A24F 40/46
(Continued)

FOREIGN PATENT DOCUMENTS

CN 105768225 A * 7/2016 ..... A24F 40/40
CN 106235420 A * 12/2016 ..... A24F 40/40
(Continued)

*Primary Examiner* — Hae Moon Hyeon
(74) *Attorney, Agent, or Firm* — Schmeiser, Olsen & Watts LLP

(57) ABSTRACT

A pod vaping system is provided. The system includes a cover having a base and a removable mouthpiece. The base retains a power source. The system also includes a cartridge having an atomizer, a reservoir and power contacts. The cartridge is removably coupled to the base by use of the mouthpiece coupling to the base with the cartridge retained within an inner volume created by coupling the mouthpiece to the base of the cover. The power contacts of the cartridge are electrically coupled to the power source. Coupling the mouthpiece to the base of the cover forms an inner volume with a unique shape. The cartridge has a unique shape that corresponds to the unique shape of the inner volume, wherein the inner volume can only receive and retain cartridges having the unique shape of the cartridge.

4 Claims, 5 Drawing Sheets

(56) References Cited

U.S. PATENT DOCUMENTS

| | | | | |
|---|---|---|---|---|
| 2020/0397059 | A1* | 12/2020 | Zongbo | A24F 7/02 |
| 2021/0212368 | A1* | 7/2021 | Taurino | A61M 15/06 |

FOREIGN PATENT DOCUMENTS

| | | | | |
|---|---|---|---|---|
| CN | 106418709 A * | 2/2017 | | A24F 40/485 |
| WO | WO-2018059218 A1 * | 4/2018 | | A24F 40/40 |

* cited by examiner

METHODS AND APPARATUS FOR A POD VAPING SYSTEM

CROSS REFERENCE TO RELATED APPLICATION[S]

This application claims priority to U.S. Provisional Patent Application entitled "POD VAPING SYSTEM," Ser. No. 62/732,207, filed Sep. 16, 2019, the disclosure of which is hereby incorporated entirely herein by reference.

BACKGROUND OF THE INVENTION

Technical Field

This invention relates generally to a vaping system and more particularly to a pod vaping system.

State of the Art

The use of inhalable substances is popular, both recreationally or for medical purposes. One form of using inhalable substances is through smoking. Those that use, particularly those that are using for medical purposes, may like the form of smoking the inhalable substance, but dislike what it visually displays to others around them or the smell that may be associated with smoking the substance. Smoking is also not a convenient form of medicating or dispensing the most medicinal substances. Vaping is an option, but vaping devices typically have open systems and are lacking in the ability to provide a closed system for consumers.

Accordingly, there is a need for an improved vaping system that operates as a closed system.

SUMMARY OF THE INVENTION

The present invention relates to a pod vaping system that provides a closed vaping system.

An embodiment includes a pod vaping system comprising a cover having a base and a removable mouthpiece, wherein the base retains a power source; and a cartridge comprising an atomizer, a reservoir and power contacts, wherein the cartridge is removably coupled to the base by use of the mouthpiece coupling to the base with the cartridge retained within an inner volume created by coupling the mouthpiece to the base of the cover, wherein the power contacts of the cartridge are electrically coupled to the power source.

The foregoing and other features and advantages of the present invention will be apparent from the following more detailed description of the particular embodiments of the invention, as illustrated in the accompanying drawings.

BRIEF DESCRIPTION OF THE DRAWINGS

A more complete understanding of the present invention may be derived by referring to the detailed description and claims when considered in connection with the Figures, wherein like reference numbers refer to similar items throughout the Figures, and:

DETAILED DESCRIPTION OF EMBODIMENTS OF THE INVENTION

Figure 1:
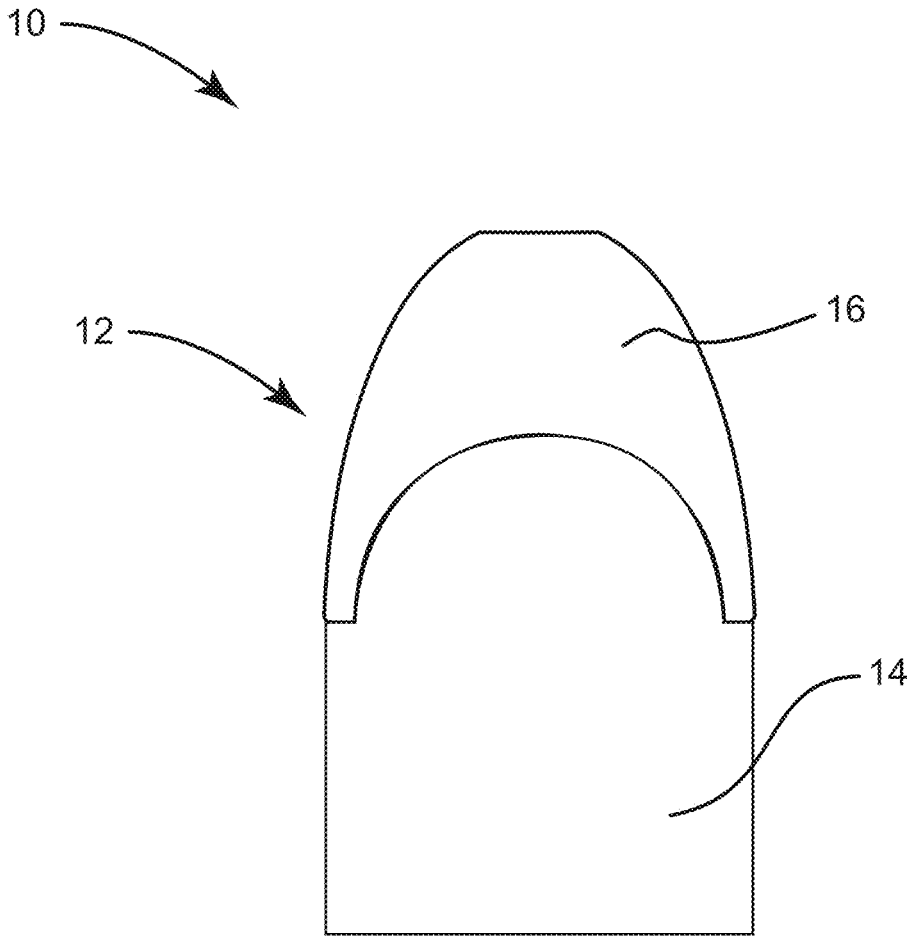
FIG. 1 is a front view of a pod vaping system in accordance with an embodiment.

As discussed above, embodiments of the present invention relate to a pod vaping system that provides a closed vaping system. A pod based system has its own unique size and shape. Further, pod based vaping systems are closed, meaning that the pods or cartridges can only be used with the power supply it was designed for. A closed system is desirable for a manufacturer of the vape fluid since it retains their customer. Once invested in the brand by purchasing the power supply, a consumer must buy only that brand of pod that will fit. The unique shape of the system becomes part of the brand.

Referring to FIGS. 1-4, an embodiment includes a pod vaping system 10. The system 10 may include a cover 12 having a base 14 and a mouthpiece 16 removably coupled to the base 14. The base 14 may include a power source 15 that is a rechargeable power source, such as a rechargeable battery and the like. Coupling the mouthpiece 16 to the base 14 creates a unique shaped inner volume bound by both the base 14 and the mouthpiece 16.

The system 10 may further include a cartridge 20, also referred to as a pod. The cartridge 20 contains the elements necessary for vaporization. Accordingly, the cartridge 20 may include an atomizer 22, a reservoir 24, and power contacts 26. The reservoir may be filled with vaping fluid.

Figure 2:
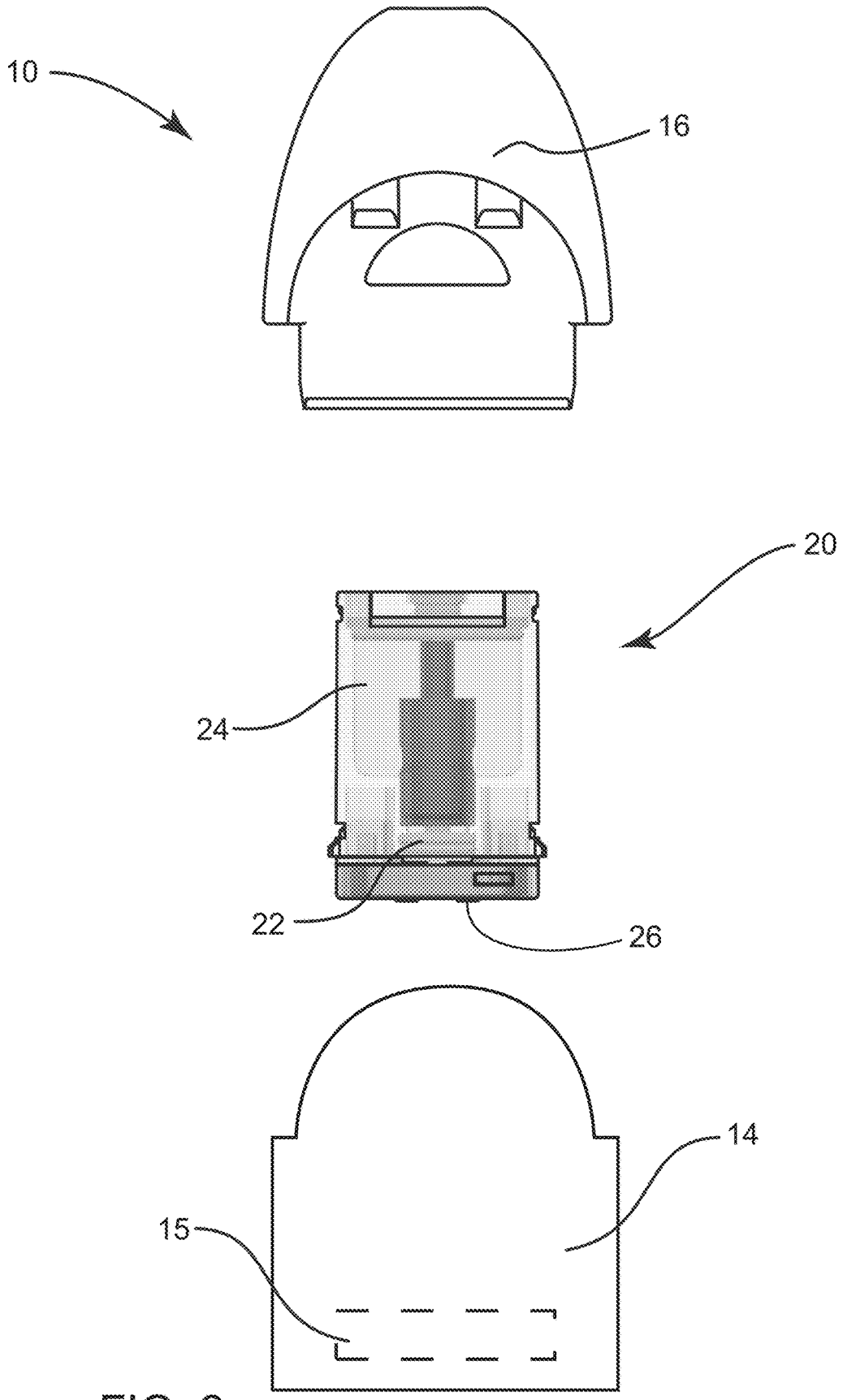
FIG. 2 is an exploded front view of a pod vaping system in accordance with an embodiment.
Figure 3:
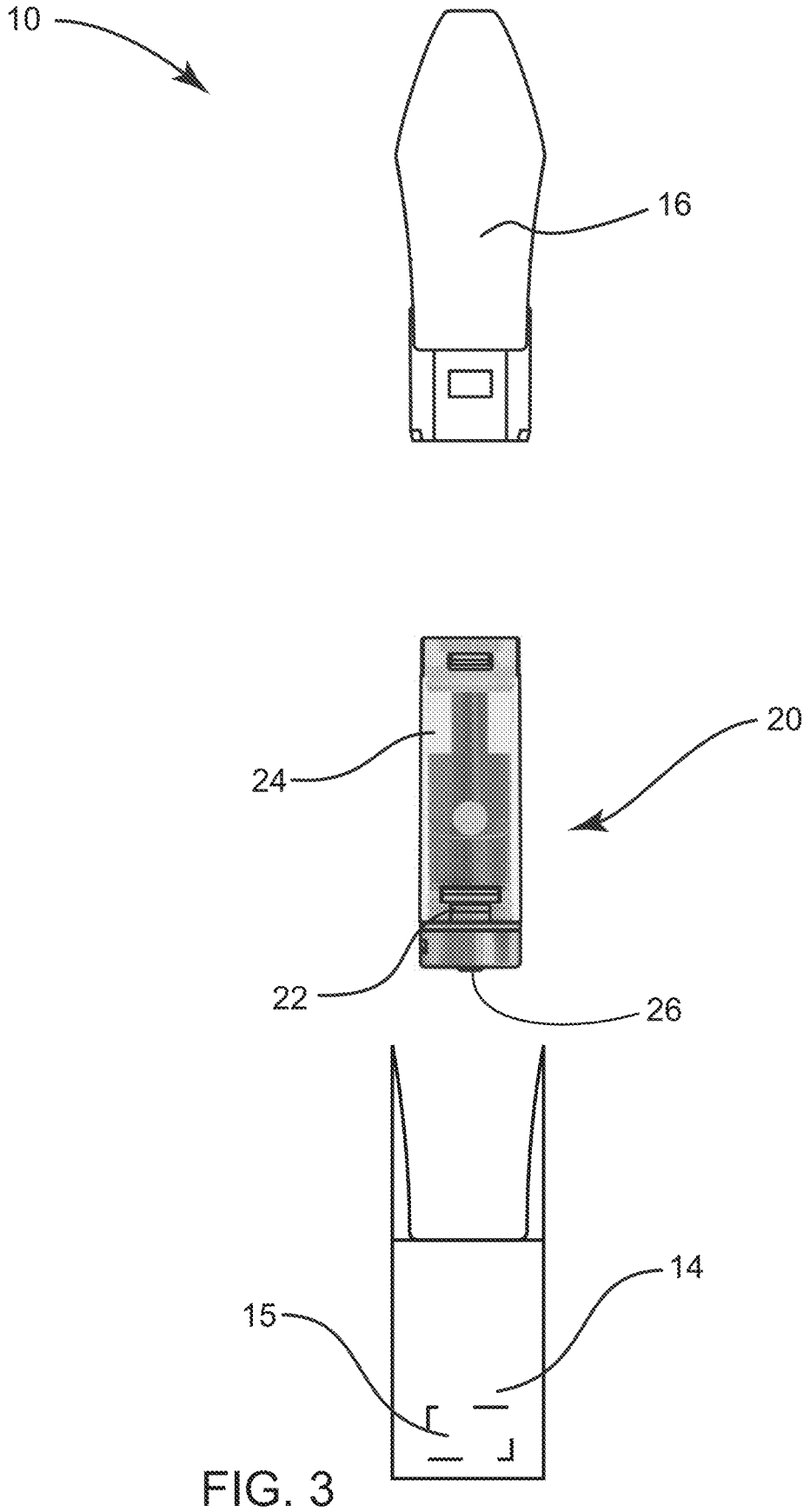
FIG. 3 is an exploded side view of a pod vaping system in accordance with an embodiment.
Figure 4:
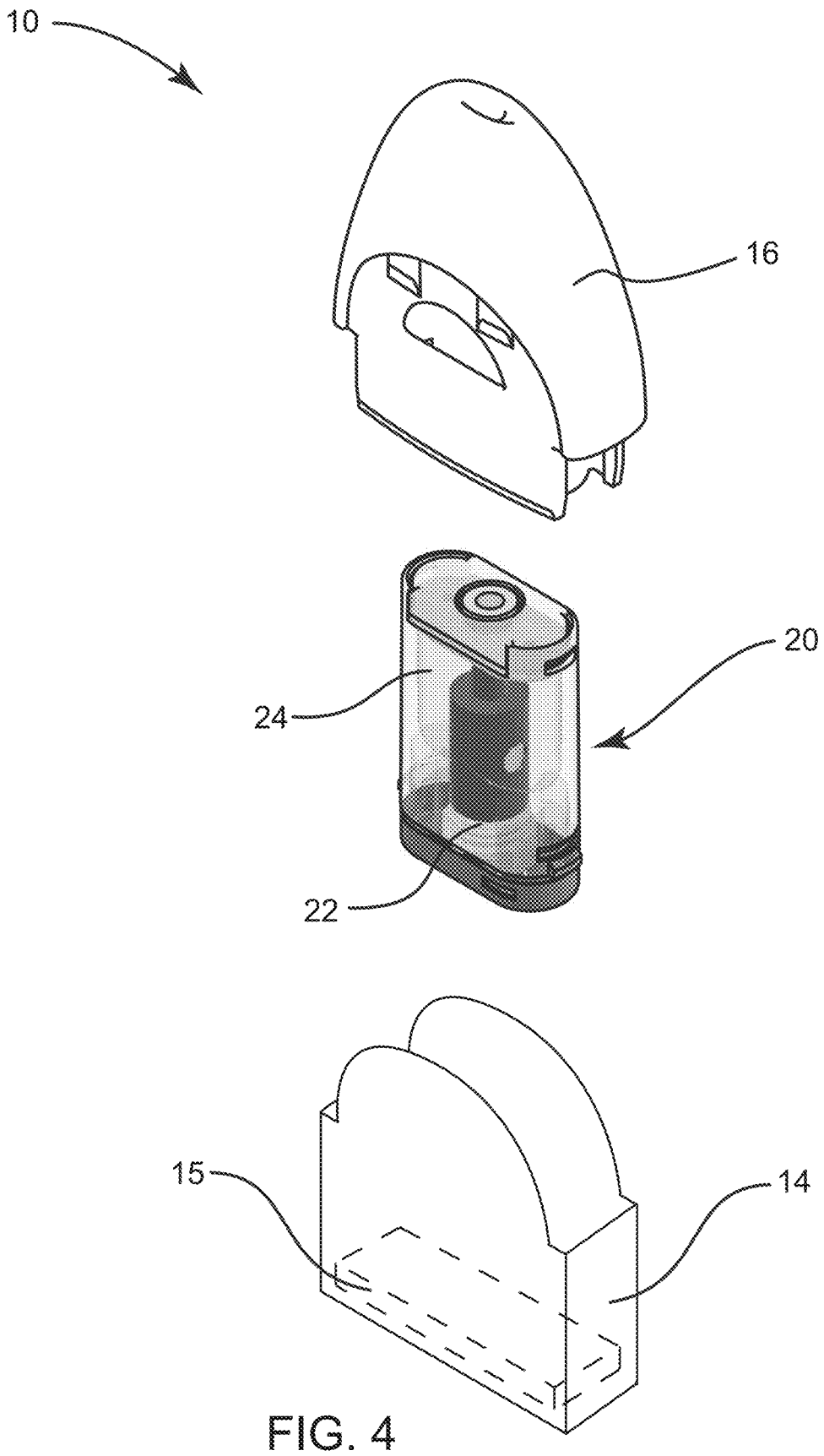
FIG. 4 is an exploded perspective view of a pod vaping system in accordance with an embodiment.
Figure 5:
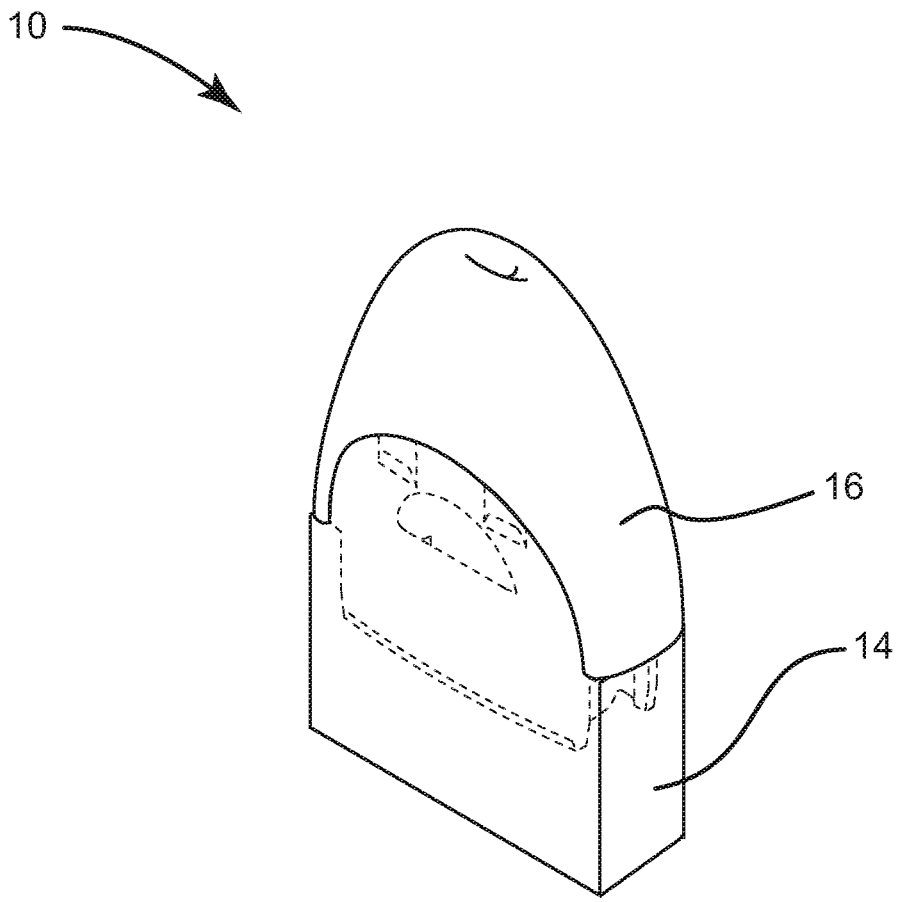
FIG. 5 is an exploded inside perspective view of a pod vaping system in accordance with an embodiment of the invention.

In operation, the cartridge 20 may be inserted into a cover 20 by inserting the cartridge 20 with the power contacts 26 being located toward the base 14 such that the power contacts 26 engage corresponding contacts (not shown) within the base 14 in order to supply power from the power source to the cartridge 20 through power contacts 26. The shape of the cartridge 20 has a unique shape that corresponds to the unique shape of the inner volume of the cover 12, thereby allowing only this specific cartridge shape to be used with the cover 12 of the pod vaping system 10. In this regard, the atomizer 22 may be selectively coupled to the power source via the power contacts 26. The mouthpiece 16 is removably coupled to the base 14 to retain the cartridge 20 in electrical contact with the power supply and to allow operation of the pod vaping system 10. Once the mouthpiece 16 is removably coupled to the base 14, the system 10 may be utilized as typical wherein the user may utilize the mouthpiece 16 to draw in vaporized vaping fluid stored within the reservoir 24, which vapor is created by the atomizer 22 drawing power from the power source through the power contacts 26. The atomizer 22 may be in contact with the reservoir 24, such as shown in FIGS. 2-4.

In embodiments, the cartridge 20 snaps into the mouthpiece 16 and is not easily removed by the consumer without the use of tools. This prevents accidental separation of the mouthpiece 16 from the base 14 and the cartridge 20 falling out and being damaged.

An advantage of this system 10 is that the cartridge 20 containing the components that require higher precision during manufacture can be manufactured in higher volume since it is used in numerous closed systems. Covers 12 can be manufactured in smaller quantities with lower precision. The covers 12 can be colored or textured differently allowing the processor to designate different products without maintaining an inventory of different colored pods for each.

The covers 12 are low cost, keeping working capital lower while maintaining the ability to change product mix as the market demands.

Another embodiment of the present invention may include a method of using a pod vaping system. The method may include inserting a uniquely shaped cartridge within a base of a cover, wherein the cartridge comprises all components necessary for vaporization including vaping fluid; removably couple a mouthpiece of the cover to the base of the cover, wherein the mouthpiece coupled to the base forms a uniquely shaped inner volume corresponding to the uniquely shaped cartridge; and operating the system to perform vaping function.

The method may include electrically coupling the cartridge to the power source of the base in response to inserting the cartridge within the base. The method may include removing the mouthpiece from the base and removing the cartridge when the vaping fluid is depleted from the cartridge. The method may include disposing of the depleted cartridge after removing it from the cover. The method may further include replacing the depleted cartridge with a filled cartridge have the same unique shape corresponding to the unique shape of the inner volume formed by the coupling of the mouthpiece to the base of the cover.

The method may include activating the vaporization of the vaping fluid by activating the atomizer within the cartridge; and drawing vaporized vaping fluid through the mouthpiece for consumption by the user.

It will be understood that embodiments are not limited to the specific components disclosed herein, as virtually any components consistent with the intended operation of a pod vaping method and/or system may be utilized. Accordingly, for example, although particular covers, cartridges, vaporization components, and other components are disclosed, such components may comprise any shape, size, style, type, model, version, class, grade, measurement, concentration, material, weight, quantity, and/or the like consistent with the intended operation of pod vaping system embodiments. Embodiments are not limited to uses of any specific components, provided that the components selected are consistent with the intended operation of a pod vaping system.

Accordingly, the components defining any pod vaping system embodiment may be formed of any of many different types of materials or combinations thereof that can readily be formed into shaped objects provided that the components selected are consistent with the intended operation of a pod vaping system embodiment. For example, the components may be formed of: rubbers (synthetic and/or natural) and/or other like materials; glasses (such as fiberglass) carbon-fiber, aramid-fiber, any combination thereof, and/or other like materials; polymers such as thermoplastics (such as ABS, Fluoropolymers, Polyacetal, Polyamide; Polycarbonate, Polyethylene, Polysulfone, and/or the like), thermosets (such as Epoxy, Phenolic Resin, Polyimide, Polyurethane, Silicone, and/or the like), any combination thereof, and/or other like materials; composites and/or other like materials; metals, such as zinc, magnesium, titanium, copper, iron, steel, carbon steel, alloy steel, tool steel, stainless steel, aluminum, any combination thereof, and/or other like materials; alloys, such as aluminum alloy, titanium alloy, magnesium alloy, copper alloy, any combination thereof, and/or other like materials; any other suitable material; and/or any combination thereof.

Furthermore, the components defining any pod vaping system embodiment may be purchased pre-manufactured or manufactured separately and then assembled together. However, any or all of the components may be manufactured simultaneously and integrally joined with one another. Manufacture of these components separately or simultaneously may involve extrusion, pultrusion, vacuum forming, injection molding, blow molding, resin transfer molding, casting, forging, cold rolling, milling, drilling, reaming, turning, grinding, stamping, cutting, bending, welding, soldering, hardening, riveting, punching, plating, and/or the like. If any of the components are manufactured separately, they may then be coupled with one another in any manner, such as with adhesive, a weld, a fastener (e.g. a bolt, a nut, a screw, a nail, a rivet, a pin, and/or the like), wiring, any combination thereof, and/or the like for example, depending on, among other considerations, the particular material forming the components. Other possible steps might include sand blasting, polishing, powder coating, zinc plating, anodizing, hard anodizing, and/or painting the components for example.

The embodiments and examples set forth herein were presented in order to best explain the present invention and its practical application and to thereby enable those of ordinary skill in the art to make and use the invention. However, those of ordinary skill in the art will recognize that the foregoing description and examples have been presented for the purposes of illustration and example only. The description as set forth is not intended to be exhaustive or to limit the invention to the precise form disclosed. Many modifications and variations are possible in light of the teachings above without departing from the spirit and scope of the forthcoming claims.

The invention claimed is:

1. A pod vaping system comprising:
- a cover having:
  - a base; and
  - a removable mouthpiece, wherein the base retains a power source; and
- a cartridge comprising:
  - power contacts;
  - a reservoir; and
  - an atomizer in contact with the reservoir and selectively coupled to the power source via the power contacts, wherein the cartridge is removably coupled to the base by use of the mouthpiece coupling to the base with a portion of the mouthpiece within the base and with the cartridge retained within an inner volume created by coupling the mouthpiece to the base of the cover, wherein the power contacts of the cartridge are electrically coupled to the power source.

2. The system of claim 1, wherein coupling the mouthpiece to the base of the cover forms the inner volume with a unique shape.

3. The system of claim 2, wherein the cartridge has a unique shape that corresponds to the unique shape of the inner volume, wherein the inner volume can only receive and retain cartridges having the unique shape of the cartridge.

4. A pod vaping system comprising:
- a cover having:
  - a base; and
  - a removable mouthpiece, wherein the base retains a power source; and
- a cartridge comprising:
  - power contacts;
  - a reservoir; and
  - an atomizer in contact with the reservoir and selectively coupled to the power source via the power contacts, wherein the cartridge is coupled into and not easily removed from the mouthpiece and is removably coupled to the base with the mouthpiece extending into the base with the cartridge retained within an inner volume created by the coupling of the mouthpiece to the base of the cover, wherein the power contacts of the cartridge are electrically coupled to the power source.

* * * * *